US005509790A

United States Patent [19]

Schuderi et al.

[11] Patent Number: 5,509,790

[45] Date of Patent: Apr. 23, 1996

[54] REFRIGERANT COMPRESSOR AND MOTOR

[75] Inventors: Carmelo J. Schuderi, Springfield; James V. Masi, Wilbraham; Stephen P. Scuderi, Westfield, all of Mass.

[73] Assignee: Engineering & Sales Associates, Inc., Springfield, Mass.

[21] Appl. No.: 214,949

[22] Filed: Mar. 16, 1994

Related U.S. Application Data

[63] Continuation-in-part of Ser. No. 181,702, Jan. 14, 1994, abandoned.

[51] Int. Cl.[6] ..... F04B 23/10

[52] U.S. Cl. ..... 417/201; 417/415; 417/423.7

[58] Field of Search ..... 417/201, 415, 417/423.7

[56] References Cited

U.S. PATENT DOCUMENTS

| | | | |
|---|---|---|---|
| 3,171,051 | 2/1965 | Burr . | |
| 3,171,356 | 3/1965 | Pensabene | 417/423.7 |
| 3,450,918 | 6/1969 | Burr . | |
| 3,450,998 | 6/1969 | Greefkes et al. . | |
| 3,498,530 | 3/1970 | Hover | 417/415 |
| 3,558,947 | 1/1971 | Burr . | |
| 4,164,690 | 8/1979 | Müller et al. | 417/423.7 |
| 4,718,830 | 1/1988 | Middleton et al. | 417/415 |
| 4,732,548 | 5/1988 | Iida et al. | 417/415 |
| 4,766,733 | 8/1988 | Scuderi . | |
| 4,797,068 | 1/1989 | Hayakawa et al. | 417/201 |
| 4,834,626 | 5/1989 | Prevosto | 417/415 |
| 4,861,237 | 8/1989 | Shiraki et al. | 417/423.7 |
| 4,981,020 | 1/1991 | Scuderi . | |
| 5,326,229 | 5/1994 | Collins | 417/201 |

OTHER PUBLICATIONS

IMC Magnetics Corp., GPM Series Printed Armature Motor; 1992.

PMI Motion Technologies, Move Into The Future With Servo Disc.

Delco Remy, Magnequency.

*Primary Examiner*—Richard A. Bertsch
*Assistant Examiner*—William Wicker
*Attorney, Agent, or Firm*—Fishman, Dionne & Cantor

[57] ABSTRACT

A compressor/motor combination device for use in refrigerant recovery and/or recycling apparatus wherein the motor employed is of the disc armature type and the drive shaft thereof also acts as the crank shaft of the compressor for reciprocating the piston therein and extends in a direction opposite the compressor to drive a fan.

11 Claims, 2 Drawing Sheets

REFRIGERANT COMPRESSOR AND MOTOR

CROSS-REFERENCE

This is a continuation-in-part of U.S. Ser. No. 181,702 filed Jan. 14, 1994, now abandoned.

FIELD OF THE INVENTION

This invention relates to a new compressor/motor combination for use in recovering refrigerant from a refrigeration system.

BACKGROUND OF THE INVENTION

Apparatus for recovering and/or recycling refrigerant from refrigeration systems has become very important in view of global concern for the environment. As is known, refrigerants such as chlorofluorocarbons (CFC's) damage the environment due to their deleterious effect on the ozone layer. As such is the case, many devices have come into use in order to safely recover and/or recycle CFC's. Examples of said recovering and recycling devices may be found in U.S. Pat. Nos. 4,766,733 and 4,981,020, both to Carmelo J. Scuderi.

In each of said patents mentioned above and in every other similar device, a compressor and means for driving the compressor, i.e. a motor, are provided. In the main, the compressor and the motor are two separate devices which are coupled together via gearing and/or other drive means. A typical compressor/motor combination is disclosed in U.S. Pat. No. 4,981,020. Such recovery/recycling apparati also normally contain a separate drive means (i.e. motor) for driving a fan. Fans are used to cool different parts of the apparatus as well as to aid in any condensing operations.

SUMMARY OF THE INVENTION

The present invention is a compressor/motor for use in refrigerant recovery/recycling apparatus for refrigeration systems wherein the two devices are joined and a single shaft acts as a drive shaft for the motor, a crankshaft for the compressor and a fan drive means. This unique combination is accomplished by employing a printed circuit motor which is an electrical motor which uses a dielectric disc as an armature. The drive shaft on which the armature is mounted also serves as the crankshaft for the compressor and a fan. Disc motors of the type employed in the present invention are disclosed in U.S. Pat. Nos. 3,171,051 and 3,558,947, both to Robert p. Burr.

DETAILED DESCRIPTION OF THE INVENTION

Figure 1:
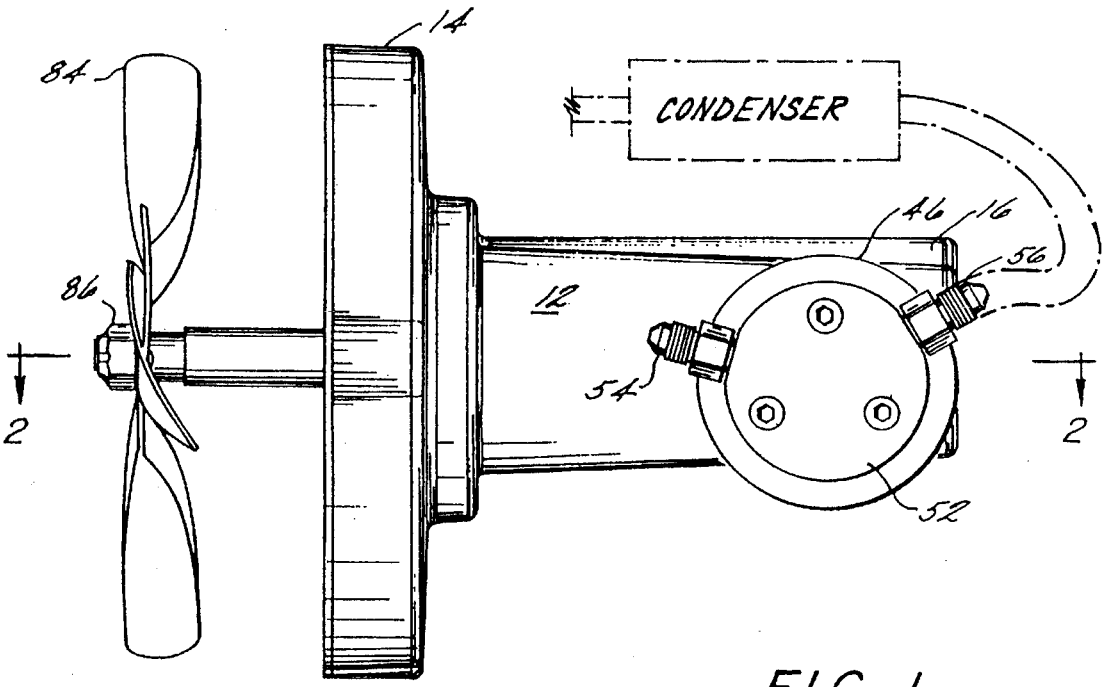
FIG. 1 is a top plan view of the compressor/motor combination of the present invention.
Figure 2:
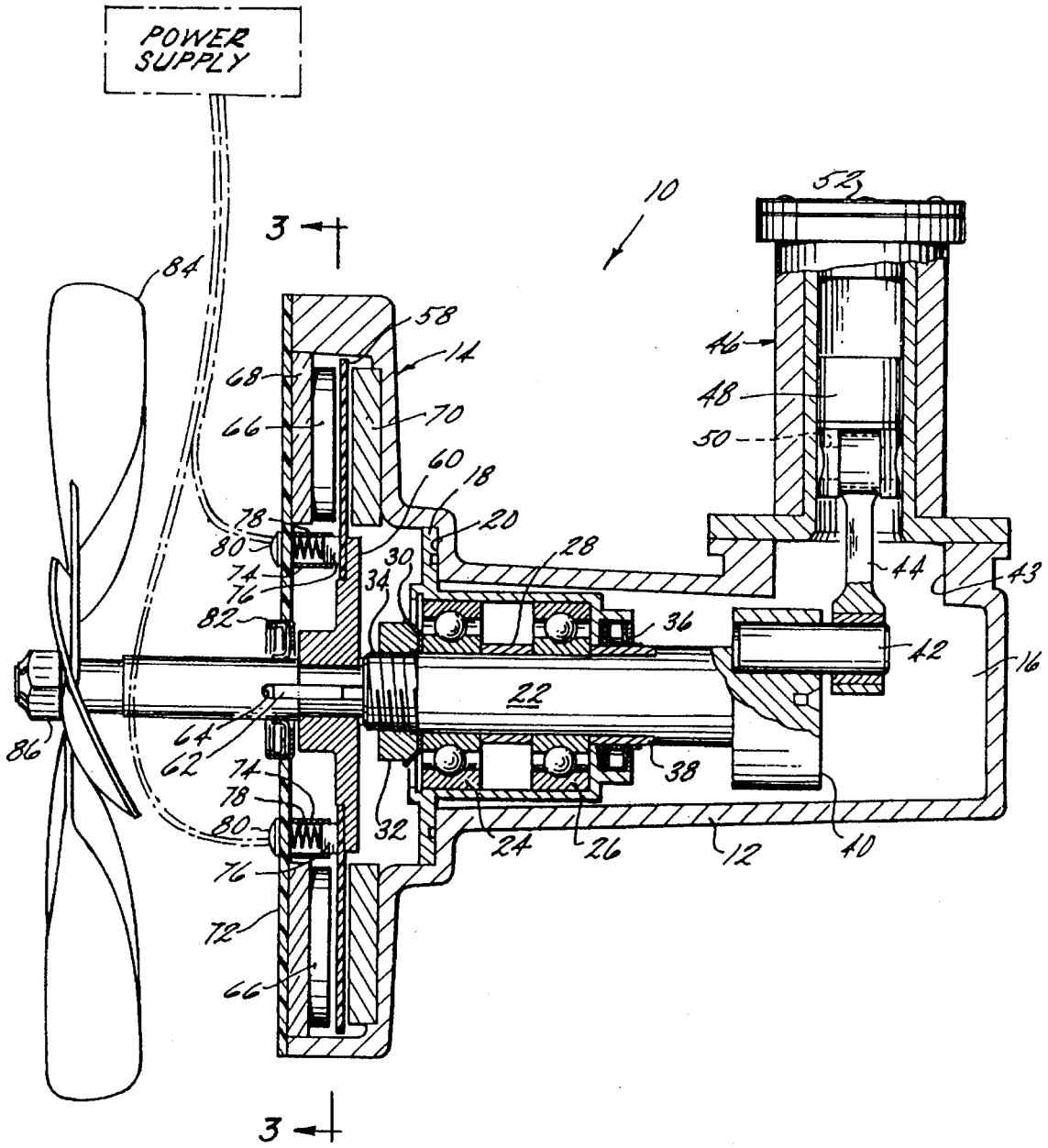
FIG. 2 is a section view taken along the line 2—2 of FIG. 1.

As shown in FIGS. 1 and 2, the compressor/motor apparatus of the present invention is shown at 10. Said device generally comprises a housing 12 having a motor section 14 and a compressor section 16. The compressor section 16 includes a bearing housing 18 which is affixed to an inner shoulder 20 of the housing 12 by bolts and the like (not shown). Said bearing housing 18 receives and rotatably supports elongated shaft 22 via bearings 24 and 26 pressed therein and separated by spacer 28. A lock ring 30 holds the bearings 24 and 26 in position in the bearing housing 18 by means of lock nut 32 which is threaded onto threads 34 of the shaft 22. As shown, a portion of the shaft 22 extends into and through the motor section 14 of the housing 12 and a portion of said shaft 22 also extends into the compressor section 16. The motor section 14 and the compressor section 16 of the housing 12 are sealed off from one another by lip seals 36 disposed between the bearing housing 18 and a hardened bushing 38 disposed on shaft 22.

As also shown in FIG. 2, the inner end of the shaft 22 is provided with an eccentric crank portion 40. A crank pin 42 is disposed in said portion 40 so that the axis thereof is parallel to the axis of the shaft 22. A crank arm 44 has one end thereof rotatably disposed on the crank pin 42, while the other end thereof extends upwardly out of said housing 12 through port 43 into a piston cylinder 46 attached to the housing 12. Said crank arm 44 is attached to a piston 48 via wrist pin 50. The piston cylinder terminates in a cap 52 which is provided with intake and outlet valves 54 and 56 respectively as seen in FIG. 1.

Figure 3:
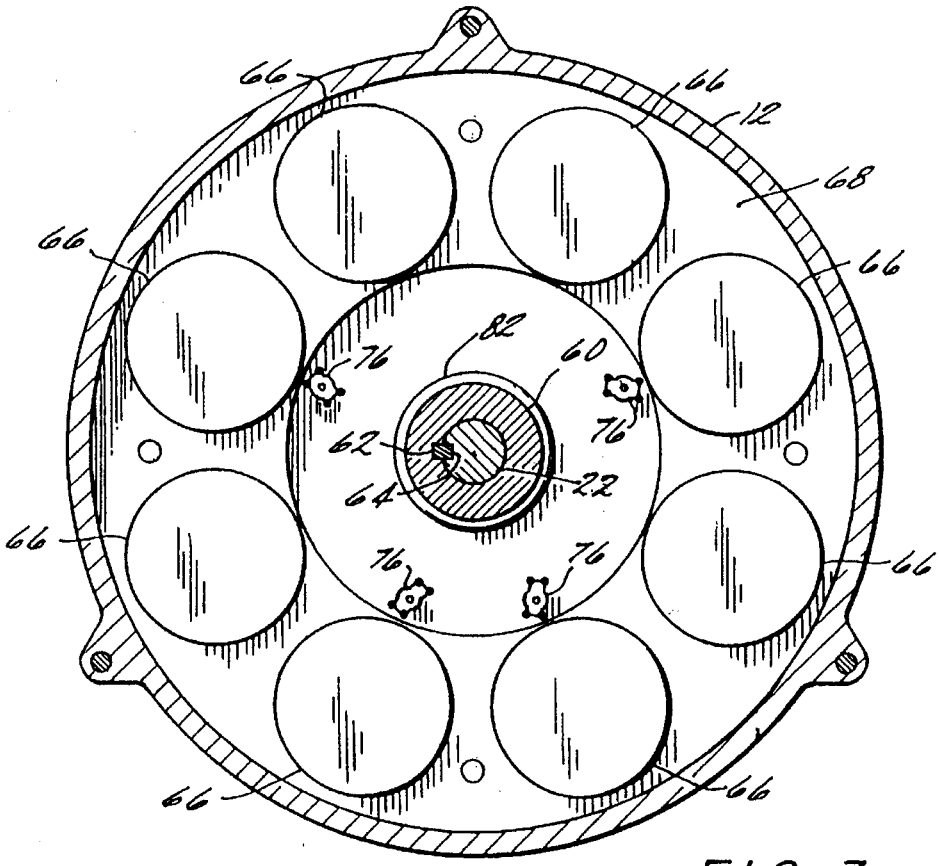
FIG. 3 is an elevation section view taken along the line 3—3 of FIG. 2.

With reference to FIGS. 2 and 3, it will be seen that the motor section 14 is disposed in an open end of the housing 12 concentric with the shaft 22. As shown, the motor section 14 comprises a disc armature 58 having electrical windings thereon (not shown) disposed on a hub 60 which is affixed to shaft 22 via key 62 and keyway 64. A magnetic field is aligned axially, parallel to the shaft 22 by a plurality of permanent magnets 66 disposed circumferentially about said shaft 22 on magnet plate 68. Said magnets, which may be AL—Ni or preferably neodymium magnets such as those sold under the trademark "Magnequench" by Delco Remy a division of General Motors Corp., are adhesively secured or cemented to the magnet plate 68 and are mounted thereon so as to provide fields of alternate polarity through adjacent regions of the armature 58. A flux return plate 70, i.e. a ferro-magnetic annulus, is positioned on the other side of the armature disc 58 from the magnets 66 to minimize the air gap in the magnetic field and to complete the magnetic field flux path.

Flux return plate 70 and magnet plate 68 are sized to closely approximate the effective annular dimension of the magnets 66 disposed circumferentially about shaft 22. Maintaining a smaller annular area on each of the aforementioned plates provides for a desirable reduction in weight over prior art motors using greater annular areas on the plates. For example, where eight one and one-half inch magnets 66 are arranged circumferentially, the inside dimension of each of plate 70 and plate 68 is preferably 3.375 inches or smaller and the outside diameters must then be 6.375 or larger. Using the indicated value provides the greatest weight reduction without flux loss. Reducing the annular area of the plates to where magnets would overhang the plates would be to suffer a dramatic and undesirable loss in flux. The loss experienced by such configuration is occasioned by an incomplete absorption of the flux (created by the magnets) by the flux return plate 70.

One of skill in the art will appreciate that where smaller diameter magnets are utilized the inside and outside diameters of the plates 70 and 68 will change accordingly.

In the most preferred embodiment of the present invention 1 ½ inch magnets are used; the diameters are those set forth above except that the outside diameter of the magnet plate 68 is slightly larger, as most preferred, (i.e. 6.781 inches) in order to engage a flange on the housing.

As depicted in FIGS. 1, 2 and 3, the magnetic plate 68 is held in place by plate or cover 72 which is affixed to the housing 12 by bolts and the like (not shown). The cover 72 is preferably made from a dielectric material and carries a plurality of brush holders 74 which extend inwardly from said cover 72. A plurality of brushes 76 are disposed in said brush holders 74 and are biased into contact with the armature 58 by springs 78. A cap 80 of insulating material maintains said brushes 76 in said brush holders 74 and provides access to said brushes 76 for appropriate electrical leads (not shown). The plate or cover 72 is also provided with a dirt seal 82 which is also in contact with shaft 22.

As shown in FIGS. 1 and 2, the outer end of the shaft 22 is provided with a fan 84 means which is affixed thereto by nut 86. Nut 86 may affix fan means 84 to shaft 22 merely by pressing the fan means 84 into frictional engagement with the shaft or the fan means may be maintained in position on a key and key way arrangement (not shown). The fan means 84 serves multiple purposes when the compressor/motor device of the present invention is properly included in a refrigerant recovery or recycling device such as described earlier. For example, the air flow of the fan 84 not only serves as a cooling means for the motor section 14 and the compressor section 16 as well as the power supply but, if correctly oriented in a recovery/recycling device, it also functions to draw air over the condensing means of said recovery/recycling device. This is a very important advancement over devices of the prior art because the device of this invention avoids the need for an additional motor to run the fan means. Therefore, both a cost and weight savings are realized by employing the claimed arrangement in a recovery/recycling system. Reduction in cost is always economically desirable, however a weight reduction is of particular importance in connection with recovery/recycling equipment because of the necessarily transportable nature of such equipment. Recovery/recycling equipment is often transported from job site to job site or carried by hand to various locations within a large facility. Therefore, weight reduction is of great desirability.

The compressor/motor device of the present invention provides many features and advantages over prior art compressor/motor combinations. For example, the single shaft design of the device is both the drive shaft of the motor and the crank shaft of the compressor. The use of a printed circuit motor rather than a conventional iron-core motor provides a small, lightweight unit that accelerates to operating speed quickly with high peak torque capability.

While the preferred embodiment of the present invention has been shown and described, various modifications and substitutions may be made thereto without departing from the spirit and scope of the invention.

What is claimed is:

1. A combined motor and compressor device for use in a refrigerant recovery or recycling apparatus, said device comprising a housing, said housing having a motor section and a compressor section;

an elongated shaft rotatably disposed in said housing and extending from said motor section to said compressor section and extending from said motor section in a direction opposite said compressor section;

a motor disposed in said motor section, said motor having a disc armature disposed on said elongated shaft and rotatable therewith, a compressor cylinder disposed on the outside of said housing in said compressor section, said cylinder having an axis which is perpendicular to the axis of said elongated shaft, a piston disposed in said cylinder for axial movement therein, a crank arm, having means connecting one end of said crank arm to said piston and means connecting the other end of said crank arm to said elongated shaft; and fan means connected to said elongated shaft at an end of said shaft opposite said crank arm whereby rotation of said shaft by said disc armature reciprocates said piston in said cylinder and spins said fan means.

2. The motor and compressor device of claim 1 wherein said means connecting said crank arm to said elongated shaft includes crank pin, said crank pin having an axis which is parallel to and offset from the axis of said elongated shaft.

3. The motor and compressor device of claim 1 wherein said fan means cools said motor, compressor, a condenser and a power supply means.

4. The motor and compressor device of claim 1 wherein said fan is rotationally driven by said shaft by a key and keyway arrangement.

5. The motor and compressor device of claim 1 wherein said fan is press fit onto said shaft and maintained thereon by a nut.

6. The motor and compressor device of claim 1 wherein said motor includes an annular-shaped magnet plate disposed on one side of said disc armature, a plurality of magnets radially disposed on said magnet plate and an annular-shaped flux return plate disposed on the other side of said disc armature.

7. The motor and compressor device of claim 2 wherein said magnets are permanent magnets.

8. The motor and compressor device of claim 3 wherein said permanent magnets are neodymium magnets.

9. The motor and compressor device of claim 6 wherein inside and outside dimensions of said magnet plate and said flux return plate closely approximate an effective annular dimension of the radially arranged magnets.

10. The motor and compressor device of claim 9 wherein the inside and outside dimensions are 3.375 inches and 6.375 inches, respectively.

11. The motor and compressor device of claim 9 wherein the inside and outside diameters of said flux plate are 3.375 and 6.375 inches, respectively, and the inside and outside diameters of said magnet plate are 3.375 and 6.781 inches, respectively.

* * * * *